US005507675A

United States Patent [19]

Frost

[11] Patent Number: 5,507,675

[45] Date of Patent: Apr. 16, 1996

[54] METHOD OF MANUFACTURING A THERMIONIC CATHODE STRUCTURE

[75] Inventor: Michael S. Frost, Southampton, England

[73] Assignee: Thorn Microwave Devices Limited, Middlesex, England

[21] Appl. No.: 267,591

[22] Filed: Aug. 19, 1994

[30] Foreign Application Priority Data

Jun. 22, 1993 [GB] United Kingdom ..... 9312851

[51] Int. Cl.[6] ..... H01J 9/04

[52] U.S. Cl. ..... 445/50; 445/51; 313/346 DC

[58] Field of Search ..... 445/50, 51; 313/346 DC

[56] References Cited

U.S. PATENT DOCUMENTS

| | | | |
|---|---|---|---|
| 3,970,888 | 7/1976 | Tratiner | 445/51 |
| 4,303,848 | 12/1981 | Shimizu et al. | 313/346 R |
| 4,570,099 | 2/1986 | Green | 313/346 DC |
| 5,126,623 | 6/1992 | Choi | 313/346 DC |
| 5,236,382 | 8/1993 | Oh | 445/50 |

FOREIGN PATENT DOCUMENTS

| | | | |
|---|---|---|---|
| 0512280 | 11/1992 | European Pat. Off. . | |
| 2321516 | 11/1973 | Germany . | |
| 55-37704 | 3/1980 | Japan | 445/50 |
| 450865 | 7/1936 | United Kingdom . | |
| 459163 | 1/1937 | United Kingdom . | |

*Primary Examiner*—P. Austin Bradley
*Assistant Examiner*—Jeffrey T. Knapp
*Attorney, Agent, or Firm*—Keck, Mahin & Cate

[57] ABSTRACT

A method of manufacturing a thermionic cathode structure comprises the steps of: (1) forming a mixture of (a) tungsten powder, (b) at least one of the group comprising alumina or zirconia or yttrium oxide powder, (c) alkaline earth metal carbonate powder, and (d) a binder, (2) pressing the mixture isostatically causing the mixture to adhere to form an electrically insulating body, (3) sintering the body in a dry hydrogen ambient thereby reducing the carbonate, and (4) coating the surface of the body or a portion of the surface with a poly-crystalline metal layer.

2 Claims, 1 Drawing Sheet

METHOD OF MANUFACTURING A THERMIONIC CATHODE STRUCTURE

This invention relates to a method of manufacturing a thermionic cathode structure comprising the steps of (a) forming a mixture comprising (i) tungsten powder, (ii) at least one of the group comprising alumina or zirconia or yttrium oxide powder, (iii) alkaline earth metal carbonate powder, and (iv) a binder, (b) pressing the mixture thereby causing the mixture to adhere to form a body, and (c) sintering the body in a reducing ambient thereby decomposing the said carbonate.

In a known such method used to manufacture discharge lamp electrodes and disclosed in U.S. Pat. No. 4,303,848, the sintered body is electrically conductive. Such electrodes are not suitable for use as replacements for dispenser cathodes, and require additional electrically insulating layers if heating elements are to be attached, thus making assembly expensive.

It is an object of the present invention to enable these disadvantages to be mitigated.

According to the invention a method of manufacturing a thermionic cathode structure as defined in the first paragraph above is characterized in that the proportion of tungsten in the mixture is sufficiently small that the sintered body is an electrical insulator, and the method further comprises the step of (d) providing a poly-crystalline metal layer on a surface of the body.

The mixture may be deposited onto a substrate prior to pressing thereby causing the mixture to adhere to the substrate to form a single body.

Figure 1:
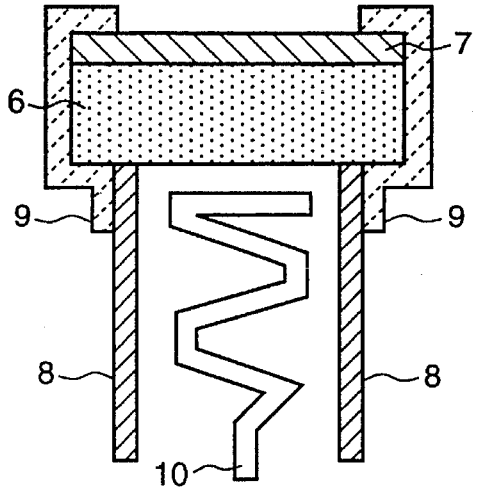
Figure 2:
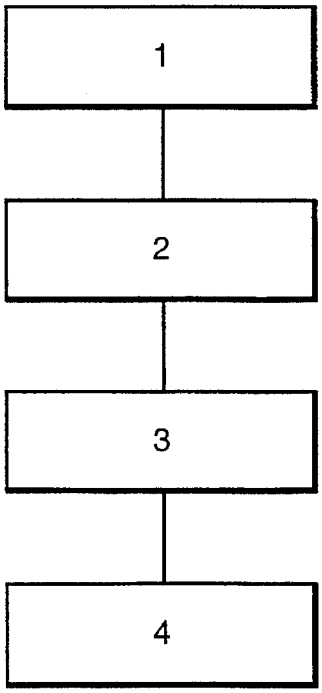

Embodiments of the invention will now be described, by way of example only, with reference to the accompanying diagrammatic drawings, in which:

FIG. 1 shows a thermionic cathode structure made using a method of manufacture according to the present invention, and FIG. 2 is a flow diagram of the method used to make the structure of FIG. 1.

In FIG. 1 a thermionic cathode structure comprises a body 6 having a poly-crystalline tungsten/osmium layer 7 deposited on its upper surface by sputtering, the body being held at one end of a cylindrical metal heat choke 8 by means of a platinum foil collar 9 spot welded to the heat choke. A heating element 10 is present adjacent the body 6.

The body 6 is manufactured by a method comprising the sequence of steps shown in the flow diagram of FIG. 2. In this diagram block 1 denotes the step of forming a mixture comprising (i) tungsten powder, (ii) at least one of the group comprising alumina or zirconia or yttrium oxide powder, (iii) alkaline earth metal carbonate powder, and (iv) a binder, block 2 denotes pressing the mixture thereby causing the mixture to adhere to form a body, block 3 denotes sintering the body in a reducing ambient thereby decomposing the said carbonate, and block 4 denotes providing a poly-crystalline metal layer on a surface of the body or a portion thereof.

In the present example the several steps comprise the following:

In step 1, a mixture is formed by placing 70 wt % barium carbonate powder, 7 wt % calcium carbonate powder, 14 wt % alumina powder and 9 wt % tungsten powder into a polythene bag containing nitrogen, sealing the bag under a nitrogen atmosphere, and mixing in a "stomacher" for 20 minutes. Two grams of the mixed powder is then combined with a binder comprising in the present case one drop of a "sintering enhancing solution" made up by dissolving 1.7 g of yttrium nitrate and 3.2 g of magnesium nitrate in 100 ml water.

In step 2 the resulting mixture is pressed. The mixture is placed in a hydraulic pellet press with a cross sectional area of 1 $cm^2$ and a pressure of 0.345 GPa (50,000 psi) is applied to the mixture. This causes the mixture to adhere to form a body. This body is then carefully removed from the press.

In step 3, the body is sintered. The sintering is carried out in a furnace in a dry hydrogen atmosphere using the following time-temperature profile-linear ramping from 20° C. to 1300° C. taking two hours, holding at 1300° C. for 130 minutes, linear ramping from 1300° C. to 1507° C. taking 5 minutes, holding at 1507° C. for 10 minutes, ramping down to room temperature taking 10 minutes.

In step 4 the body 6 is provided with a poly-crystalline metal layer on its upper surface. A layer 0.3 microns thick comprising 50% osmium and 50% tungsten is deposited by sputtering.

Other proportions of the starting materials may be used if desired. Preferably, between 5 and 50% tungsten powder, between 40 and 80% barium carbonate powder, between 0 and 40% further alkaline earth carbonate powder, and between 3 and 30% alumina or zirconia or yttrium oxide powder is used. The binder need not be a liquid; it may be, for example, a powdered solid.

The pressure used to press the mixture to form the body need not be 0.345 GPa (50,000 psi)—pressures higher or lower may be used if desired. The mixture may be compacted (by, for example, ultrasonic compaction) prior to pressing to increase the mechanical stability of the resulting body or promote adhesion. Heat energy may also be applied during the pressing if desired.

Other poly-crystalline metal layers such as for example tungsten or osmium or molybdenum or mixtures thereof may be used in place of the osmium and tungsten mixed layer described above. As an alternative, the metal layer may be deposited onto the body after it has been placed into the heat choke assembly. The metal layer may also be constituted by a plurality of sub-layers, for example one deposited onto the body before attaching to the heat choke asembly, and one subsequent to attaching to the heat choke assembly.

An alternative temperature time profile to that described in the first embodiment above may be used to sinter the body, provided that it results in forming an electrically insulating body and in decomposing the carbonates at least in part. Temperatures up to 1800° C. may be used for short periods, as may temperatures below 1400° C. If powdered yttrium oxide is used lower sintering temperatures may be used. Other reducing ambients, for example mixtures of hydrogen and nitrogen may be used as an alternative to dry hydrogen during sintering.

In a second embodiment, a mixture of 60 wt % barium carbonate powder, 20 wt % alumina powder, and 20 wt % tungsten powder is formed in an identical manner to that described above with the same binder as described above. It is then placed on a disc-shaped alumina substrate 1 mm in thickness and 1 cm in diameter. This assembly is pressed in a manner identical to that described above to form a body in the shape of a disc 1 cm in diameter. This body is then sintered using a temperature time profile identical to that described above, and a layer of poly-crystalline tungsten 0.9 microns thick is subsequently sputtered onto its upper surface.

In this embodiment the substrate may be made from other electrically insulating materials such as, for example, boron nitride. The alternative proportions of starting materials, temperature-time profiles, isostatic pressures etc. described above for the first embodiment may be used for the second embodiment also. The mixture may, for example, be deposited onto the substrate in a pattern by screen printing or using other standard techniques.

Thermionic cathode structures manufactured using the above method may have similar efficiencies to production dispenser cathodes. The cathode shown in FIG. 1, with a diameter of 1 cm, had a zero field emission of approximately 9 A $cm^{-2}$ at 1050° C. Such cathodes may, for example, be manufactured with heating elements integral with or in contact with the electrically insulating body using standard techniques.

I claim:

1. A method of manufacturing a thermionic cathode structure comprising the steps of:

(a) forming a mixture comprising:

(i) between 5 wt % and 50 wt % tungsten powder, (ii) at least one member selected from the group consisting of alumina, zirconia and yttrium oxide powder, (iii) alkaline earth metal carbonate powder, and (iv) a binder, (b) pressing the mixture, thereby causing the mixture to adhere to form a body, and (c) sintering the body in a reducing ambient thereby decomposing the said carbonate powder, characterized in that the sintered body is an electrical insulator; and the method further comprises the step of (d) providing a polycrystalline metal layer on a surface of the body.

2. A method of manufacturing a thermionic cathode structure as claimed in claim 1 in which the said mixture is deposited onto a substrate prior to pressing thereby causing the said mixture to adhere to the substrate to form a single body.

* * * * *